United States Patent [19]

Liebel

[11] Patent Number: 5,040,696

[45] Date of Patent: Aug. 20, 1991

[54] EXTENDED LENGTH PACKAGING

[75] Inventor: Henry L. Liebel, Cincinnati, Ohio

[73] Assignee: Shippers Paper Products Company, Loveland, Ohio

[21] Appl. No.: 509,160

[22] Filed: Apr. 16, 1990

[51] Int. Cl.[5] ..... B65D 90/04; B65D 5/00

[52] U.S. Cl. ..... 220/441; 206/594; 206/521; 206/491; 220/418; 229/115

[58] Field of Search ..... 206/594, 521, 491; 220/441, 418, 443; 229/115

[56] References Cited

U.S. PATENT DOCUMENTS

| | | | |
|---|---|---|---|
| 1,816,321 | 7/1931 | Foss | 206/594 X |
| 2,514,295 | 7/1950 | Scurich, Jr. | 206/521 |
| 2,934,251 | 4/1960 | Kramer | 220/441 |
| 3,084,844 | 4/1963 | Rattner | 229/115 |
| 3,266,705 | 8/1966 | Wood | 206/594 X |

FOREIGN PATENT DOCUMENTS

| | | | |
|---|---|---|---|
| 284298 | 11/1965 | Australia | 220/441 |
| 1141221 | 12/1962 | Fed. Rep. of Germany | 220/441 |
| 504406 | 12/1954 | Italy | 220/441 |
| 623549 | 8/1961 | Italy | 220/441 |

*Primary Examiner*—William I. Price

*Attorney, Agent, or Firm*—Wood, Herron & Evans

[57] ABSTRACT

A relatively light-weight, rigid, non-kinking packaging for containing and shipping non-self-supporting articles of extended length including a corrugated box and a honeycomb core adhered to one or more sides of the box interiorly thereof along substantially the length of the box defining a space for receiving the product to be packaged.

8 Claims, 1 Drawing Sheet

EXTENDED LENGTH PACKAGING

BACKGROUND OF THE INVENTION

There are numerous manufactured products which are of an extended length, e.g., over eight feet in length, which are not self-supporting and which require packaging for storage and shipment. For example, thin, light-weight aluminum and plastic extrusions of eight feet or greater length are not self-supporting; and, thus when the product is lifted, it bends or kinks at one or more points along its length. With aluminum and plastic extrusions, the bending and kinking can produce a permanent defect in the product making it unusable for sale for its intended purpose. One example of such a product are thin-slat venetian blinds, commonly called mini-blinds, which are often manufactured in lengths over eight feet to span a window over eight feet in width or to be oriented vertically in a window eight or more feet high. These blinds are typically shipped in cardboard packaging which, of course, have a length equal to or greater than the length of the blind. In the process of transporting the packaging, if it is lifted at one end, the weight of the blind causes kinking of the packaging along its length and in turn kinking of the blinds. That is, the box does not have sufficient strength to support the product contained therein and in turn will deform and kink, and kink the product. Typically, for example, in a four-sided box, the sides have a tendency to deform into a parallelogram resulting in bending of the box at some point along its length.

BRIEF DESCRIPTION OF THE INVENTION

Accordingly, there is a need for improved packaging for containing and shipping articles of extended length which are not self-supporting such as in lengths of eight feet and greater. To this end, the present invention provides a relatively light-weight, rigid, non-kinking packaging for containing and shipping non-self-supporting articles of extended length. The packaging comprises a corrugated box having side walls and ends and a length of at least about eight feet and a paperboard honeycomb insert adhered to one or more sides of the box in the interior thereof along substantially the length of the box. In a presently preferred form of the invention, the packaging is a four-sided corrugated box which is formed from a pre-creased blank into initially a three-sided trough. A paperboard honeycomb blank is scored through one sheet and the honeycomb and is likewise formed into a trough which is inserted in the box and abuts to the interior walls thereof. The honeycomb is preferably formed of paperboard comprising a number of cells between facing sheets of linerboard. The product to be packaged, for example, window blinds are then placed in the trough formed by the honeycomb, and the open side of the box is closed and sealed and the ends thereof closed and sealed. The present invention thus provides a relatively lightweight and rigid container which will not parallelogram when lifted at one end with an article contained therein but, rather, will remain rigid and non-kinking thereby protecting the packaged article throughout its shipment and storage.

BRIEF DESCRIPTION OF THE DRAWINGS

FIG. 1A is an enlarged view of a portion of the honeycomb shown in FIG. 1.

DETAILED DESCRIPTION OF THE INVENTION

Figure 1:
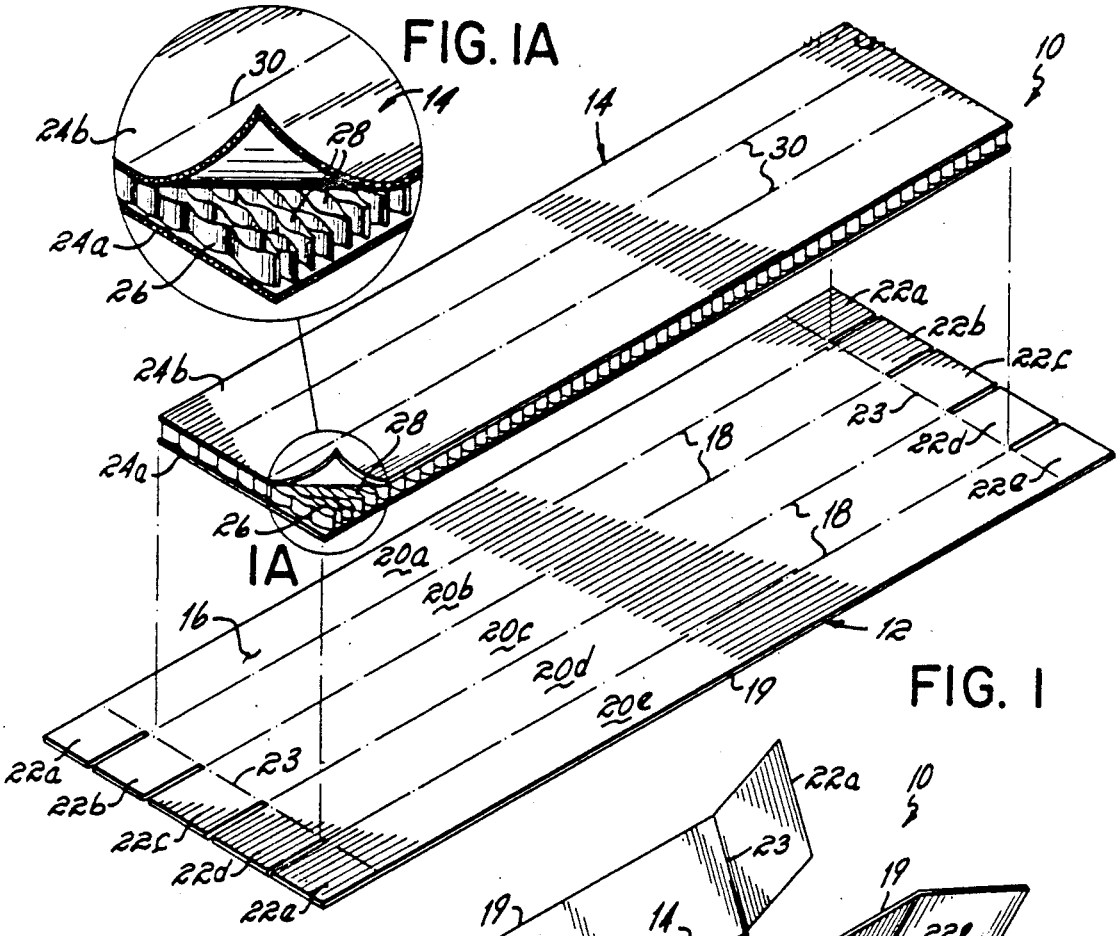
FIG. 1 is a view of the corrugated blank and honeycomb in an unassembled condition making up the packaging of the present invention.
Figure 2:
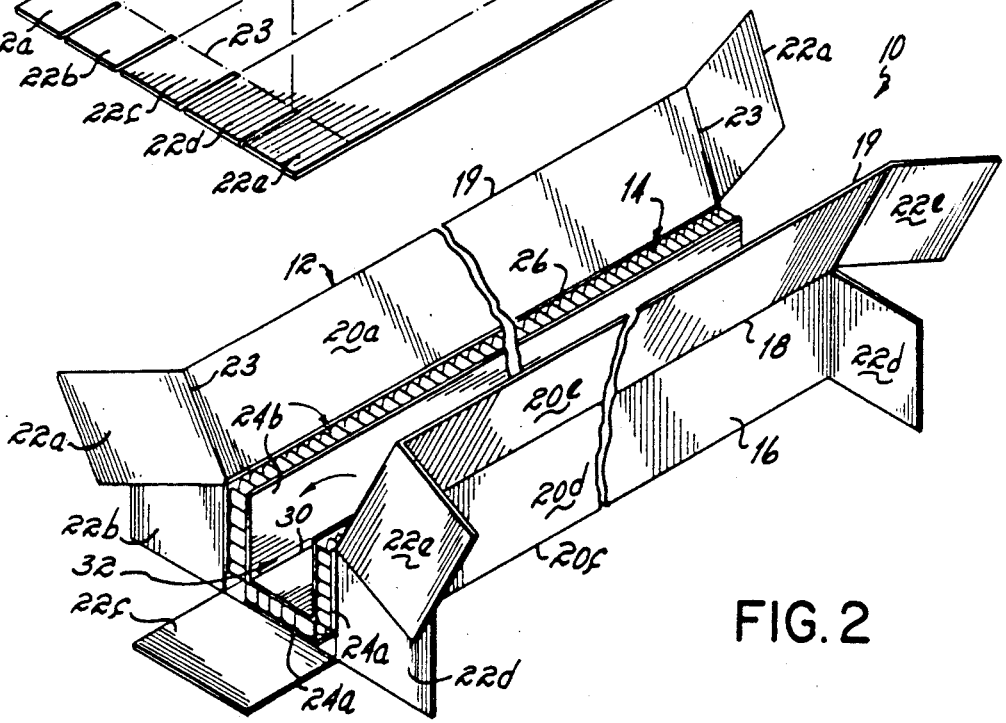
FIG. 2 is an isometric illustration showing the container in a partially completed condition for receiving product therein.

Referring now to the drawings and specifically to FIGS. 1 and 2, the packaging 10 of the present invention is formed essentially of two elements: a double faced outside corrugated blank 12 which is formed into the shape of a rectangular box and an inner paperboard honeycomb core 14. In the embodiment shown in FIGS. 1 and 2, the blank 12 of doubled faced corrugated board 12 has a center portion 16 in which creases 18 are placed extending in the direction of the long edges 19 of the blank 12. Four long creases 18 are formed to provide hinges joining five panels 20*a–e*. At the ends, the blank 12 is slit through at the crease lines 18 to form end flaps 22*a–e*. End flaps 22*a–e* are hinged to panels 20*a–e* by transverse crease lines 23. A suitable corrugated board is 200 pound C-flute.

The honeycomb core 14 has a length equalling generally the length of the center portion 16 of the corrugated blank 12 and a width a little less than the combined width of panels 20*b, c,* and *d*. The honeycomb core 14 is formed of facing sheets of linerboard 24*a* and 24*b*, and a paperboard honeycomb 26 glued to sheets 24*a* and 24*b* forming a plurality of cells 28 therebetween (FIG. 1A). The core 14 is slit through one sheet 24*a* to the top sheet 24*b* along lines 30 permitting the honeycomb core to be formed into a three panel trough-like configuration, as shown in FIG. 2. A suitable honeycomb core thickness is one inch.

Figure 3:
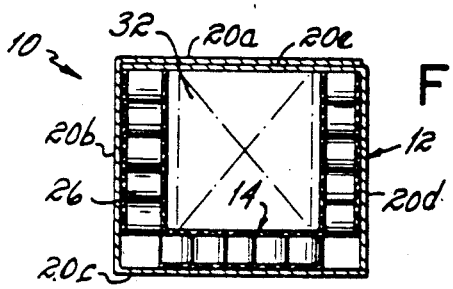
FIG. 3 is an enlarged end view of the container shown in FIG. 2 in the closed condition.

It is desirable for maximizing shipping space that the blank 12 and core 14 shown in FIG. 1 be sent to the packager in the flat condition for the packager to erect and assemble as part of its packaging process. This saves substantially in shipping space. Thus, at the point of packaging, which may be at the product manufacturer, such as a mini-blind manufacturer, the corrugated blank is folded along its creases 18 into a trough-like configuration shown in FIG. 2 having an open top. The honeycomb core 14 is then bent into its trough-like configuration shown in FIG. 2 and inserted within the corrugated blank 12. A suitable glue such as a cold white glue maybe is placed between the facing layer 24*a* of the honeycomb core 14 and the corrugated blank 12 to secure the honeycomb core 14 in place against sections 20*b, c,* and *d*. The product is now placed in space 32 defined by the trough and the top flaps 20*a* and 20*e* are bent into an overlying relation and glued or otherwise secured together as shown in FIG. 3. Likewise, the end flaps 22*a–e* are folded into overlying relation and glued or otherwise secured shut to form the assembled package with product contained therein.

Figure 4:
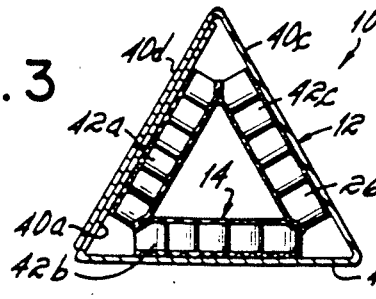
FIG. 4 is an end view of a second embodiment of the invention.

In a second embodiment of the invention, it is sometimes desirable to package articles in a triangular shaped box as opposed to a rectangle for even greater rigidity. Thus, the corrugated blank shown in FIG. 1 can be formed with four panels 40*a–d* rather than five whereupon it can be folded into a triangular container as shown in FIG. 4. In this embodiment, two of the honeycomb sections 42*b* and 42*c* would abut the corrugated board. The product to be packaged is then placed therein, the third honeycomb section 42*a* bent to complete the triangle. Glue may be placed on the outer surface thereof to adhere to the inner face of the corrugated section 40*a* when the container is closed. Section 40*d* is then folded into overlying relation with 40*a* and glued or otherwise secured thereto.

In the embodiment shown in FIGS. 1–3, the honeycomb provides rigidity to the box; and prevents the box from parallelogramming when it is picked up particularly at an extreme end. Thus, the box can support articles of extended length, for example, eight feet and over but yet be relatively lightweight and inexpensive to manufacture, ship, and use.

Thus having described the invention, what is claimed is:

1. A kit for assembly into a relatively light-weight, rigid, non-kinking packaging for non-self-supporting articles of extended length comprising:

a double-faced corrugated board blank of a length of at least eight feet having crease lines extending in a long direction between transverse crease lines and end flaps formed by slits through the corrugated board along the crease lines at the outboard ends thereof, said blank having four long crease lines defining five foldable panels, and a honeycomb core having opposed paperboard sheets with a paperboard honeycomb therebetween and three panels of a length generally equal to the length of said foldable corrugated panels, said honeycomb core being slit through on one side to the opposed sheet permitting its folding into three panels corresponding to three panels of said corrugated member, said corrugated board blank being foldable into a trough-like configuration defined by three of the five panels and said honeycomb core being assembleable inside of said corrugated board blank and the facing sheets thereof abutting said three panels to form the assembled package, the remaining two panels being foldable into overlying relation to close said packaging.

2. A relatively lightweight, rigid, non-kinking packaging for non-self-supporting articles of extended length comprising:

a box having panels defining a first space interiorly thereof, said panels meeting to define interior corners, a paperboard honeycomb core in said first space extending along the length of said panels and being abutted to said panels, said honeycomb core having at least one facing sheet facing inwardly of said packaging and defining a second space for receiving said articles, said honeycomb core being severed through to said one facing sheet at said panel interior corners to define voids free of honeycomb material at and along said panel interior corners between said panels and said honeycomb core.

3. The relatively lightweight, rigid, non-kinking packaging for non-self supporting articles of extended length of claim 2 wherein said box is formed of double-faced corrugated board.

4. A relatively lightweight rigid, non-kinking packaging for non-self-supporting articles of extended length of claim 7 wherein said honeycomb core has opposed facing sheets, and wherein said core is severed through the other of said facing sheets to said one facing sheet.

5. A relatively lightweight, rigid, non-kinking packaging for non-self-supporting articles of extended length comprising:

a box formed of corrugated board of an extended length having three panels defining a first space and a fourth panel for closing said packaging, said three panels meeting to define two interior corners, a paperboard honeycomb core in said first space extending along the length of said three panels interiorly thereof and being abutted to said three panels, said honeycomb core having at least one facing sheet inwardly of said packaging and defining a second space for receiving said articles, said honeycomb core being severed through to said one facing sheet at said two interior corners to define a pair of voids free of honeycomb material at and along said two interior corners between said three panels and said honeycomb core.

6. A relatively lightweight, rigid, non-kinking packaging for non-self-supporting articles of extended length comprising:

a box formed of double-faced corrugated board of an extended length having longitudinal fold lines extending in a long direction between transverse fold lines, said longitudinal fold lines defining at least four foldable panels, said box further comprising end flaps formed by slits through said corrugated board along said longitudinal fold lines outward from said transverse fold lines, three of said panels meeting to define two interior corners, a paperboard honeycomb core mounted in said box abutting at least three of said four panels and extending along the length of said box, said honeycomb core having at least one facing sheet inwardly of said packaging defining a space for receiving said articles, said honeycomb core being severed through to said one facing sheet at said two interior corners to define a pair of voids free of honeycomb material at and along said two interior corners between said three panels and said honeycomb core.

7. The packaging of claims 2, 3, 4, 5, or 6 wherein said honeycomb core is adhered to said panels.

8. A kit for assembly into a relatively lightweight, rigid, non-kinking packaging for non-self-supporting articles of extended length comprising:

a corrugated board blank of extended length having crease lines extending in a long direction defining foldable panels, and a honeycomb core having a paperboard facing sheet with a paperboard honeycomb attached thereto of a length generally equal to the length of said foldable corrugated panels, said honeycomb being slit through to said facing sheet permitting its folding into panels corresponding to said panels of said corrugated member, said corrugated board blank being foldable into a trough-like configuration defined by said panels and said honeycomb core being assembleable inside of said corrugated board blank abutting said panels to form the assembled package.

* * * * *